US009091266B2

(12) United States Patent
Imada et al.

(10) Patent No.: US 9,091,266 B2
(45) Date of Patent: Jul. 28, 2015

(54) SCROLL COMPRESSOR HAVING A BACK PRESSURE CONTROL VALVE FOR OPENING AND CLOSING A COMMUNICATION PATH IN A STATIONARY SCROLL

(75) Inventors: Kouichi Imada, Tokyo (JP); Mutsunori Matsunaga, Tokyo (JP); Takeshi Tsuchiya, Tokyo (JP); Shuji Hasegawa, Tokyo (JP); Yoshihiro Fukaya, Tokyo (JP); Hiromu Takeda, Tokyo (JP); Masatsugu Chikano, Tokyo (JP)

(73) Assignee: Hitachi Appliances, Inc., Tokyo (JP)

( * ) Notice: Subject to any disclaimer, the term of this patent is extended or adjusted under 35 U.S.C. 154(b) by 0 days.

(21) Appl. No.: 14/000,941

(22) PCT Filed: Mar. 29, 2011

(86) PCT No.: PCT/JP2011/057824

§ 371 (c)(1),
(2), (4) Date: Sep. 6, 2013

(87) PCT Pub. No.: WO2012/131904

PCT Pub. Date: Oct. 4, 2012

(65) Prior Publication Data

US 2014/0010693 A1 Jan. 9, 2014

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/02*** | (2006.01) |
| ***F04C 29/12*** | (2006.01) |
| ***F04C 23/00*** | (2006.01) |
| *F04C 27/00* | (2006.01) |

(52) U.S. Cl.

CPC ..... *F04C 18/02* (2013.01); *F04C 18/0215* (2013.01); *F04C 18/0253* (2013.01); *F04C 23/008* (2013.01); *F04C 29/12* (2013.01); *F04C 29/126* (2013.01); *F04C 27/005* (2013.01)

(58) Field of Classification Search

USPC ..... 418/55.1–55.6, 57, 180, 15, 270

See application file for complete search history.

(56) References Cited

U.S. PATENT DOCUMENTS

2007/0201997 A1 * 8/2007 Hiwata et al. ..... 418/55.6

FOREIGN PATENT DOCUMENTS

| | | | | | |
|---|---|---|---|---|---|
| JP | 11-132164 | A | | 5/1999 | |
| JP | 2005120939 | A | * | 5/2005 | ..... F04C 18/02 |
| JP | 2005-163655 | A | | 6/2005 | |
| JP | 2007321685 | A | * | 12/2007 | ..... F04C 18/02 |
| JP | 2008-2311 | A | | 1/2008 | |
| JP | 2008002419 | A | * | 1/2008 | ..... F04C 18/02 |
| JP | 2009270433 | A | * | 11/2009 | ..... F04C 18/02 |
| JP | 2010-53798 | A | | 3/2010 | |
| JP | 2012-207606 | A | | 10/2012 | |

OTHER PUBLICATIONS

Corresponding International Search Report with English Translation dated Jun. 21, 2011 (five (5) pages).

* cited by examiner

*Primary Examiner* — Theresa Trieu

(74) *Attorney, Agent, or Firm* — Crowell & Moring LLP

(57) ABSTRACT

A scroll compressor includes a crankshaft, a suction chamber, a back pressure chamber, a communication path, a back pressure control means, and a base plate. The base plate intermittently connects the communication path by opening and closing an opening on a back pressure chamber side of the communication path. The crankshaft drives an orbiting scroll, and mutually engages a stationary scroll having a whirlpool shape and the orbiting scroll.

5 Claims, 14 Drawing Sheets

(a) WHEN ORBITING SCROLL BASE PLATE IS CLOSEST TO THE OUTER CIRCUMFERENTIAL SECTION (b) WHEN ORBITING SCROLL BASE PLATE IS FARTHEST FROM THE OUTER CIRCUMFERENTIAL SECTION (a) WHEN ORBITING SCROLL BASE PLATE IS CLOSEST TO THE OUTER CIRCUMFERENTIAL SECTION (b) WHEN ORBITING SCROLL BASE PLATE IS FARTHEST FROM THE OUTER CIRCUMFERENTIAL SECTION (a) WHEN ORBITING SCROLL BASE PLATE IS CLOSEST TO THE OUTER CIRCUMFERENTIAL SECTION (b) WHEN ORBITING SCROLL BASE PLATE IS FARTHEST FROM THE OUTER CIRCUMFERENTIAL SECTION (a) WHEN ORBITING SCROLL BASE PLATE IS CLOSEST TO THE OUTER CIRCUMFERENTIAL SECTION (b) WHEN ORBITING SCROLL BASE PLATE IS FARTHEST FROM THE OUTER CIRCUMFERENTIAL SECTION (a) WHEN ORBITING SCROLL BASE PLATE IS CLOSEST TO THE OUTER CIRCUMFERENTIAL SECTION (b) WHEN ORBITING SCROLL BASE PLATE IS FARTHEST FROM THE OUTER CIRCUMFERENTIAL SECTION (a) WHEN ORBITING SCROLL BASE PLATE IS CLOSEST TO THE OUTER CIRCUMFERENTIAL SECTION (b) WHEN ORBITING SCROLL BASE PLATE IS FARTHEST FROM THE OUTER CIRCUMFERENTIAL SECTION (a) WHEN ORBITING SCROLL BASE PLATE IS CLOSEST TO THE OUTER CIRCUMFERENTIAL SECTION (b) WHEN ORBITING SCROLL BASE PLATE IS FARTHEST FROM THE OUTER CIRCUMFERENTIAL SECTION (a) WHEN ORBITING SCROLL BASE PLATE IS CLOSEST TO THE OUTER CIRCUMFERENTIAL SECTION (b) WHEN ORBITING SCROLL BASE PLATE IS FARTHEST FROM THE OUTER CIRCUMFERENTIAL SECTION

SCROLL COMPRESSOR HAVING A BACK PRESSURE CONTROL VALVE FOR OPENING AND CLOSING A COMMUNICATION PATH IN A STATIONARY SCROLL

TECHNICAL FIELD

The present invention relates to a scroll compressor utilized in refrigerant compressors for air conditioning and freezers, or compressors for compressing gas such as air.

BACKGROUND ART

A screw compressor of the related art is described for example in Japanese Unexamined Patent Application Publication No. 2005-163655 (Patent Literature 1). This technology of the related art includes: "a non-orbiting scroll member, an orbiting scroll member forming a suction chamber or a compression chamber by orbital motion engaging with the non-orbiting scroll member, a back pressure chamber to apply a pressing force against the non-orbiting scroll member to the scroll member, a back pressure chamber fluid inflow means to flow a fluid into the back pressure chamber to maintain the back pressure serving as the compression chamber pressure, and a back pressure chamber fluid outflow means to flow the inflow fluid into the suction chamber or back pressure chamber. The back pressure fluid outflow means includes in a series arrangement: a back pressure control valve to control the upstream and downstream pressure differential, and a throttle flow path, and an intermittent flow path intermittently connecting by way of the orbital motion of the orbiting scroll member along the back pressure chamber fluid outflow path connecting the back pressure chamber and suction chamber or compression chamber.

CITATION LIST

Patent Literature

Patent literature 1: Japanese Unexamined Patent Application Publication No. 2005-163655

SUMMARY OF INVENTION

Technical Problem

In the scroll compressor, a gas and oil compression effect acts on the orbital edge plate side surface of the back pressure chamber, along with the orbital motion of the orbiting scroll member. In the method disclosed in the patent literature 1, an orbital outer circumferential groove was formed to avoid gas and oil compression. This method alleviated pressure fluctuations on the orbital edge plate side surface of the back pressure chamber, however the pressure fluctuations were not completely eliminated and caused fluctuations in pressure in the back pressure valve inflow hole. Pressure on the orbital edge plate side surface reaches a maximum when the orbital edge plate is closest to the outer circumference; and the pressure reaches a minimum when the orbital edge plate is farthest away from the outer circumference. Orbital edge plate side surface pressure fluctuations acting directly on the back pressure valve plate, promote abnormal vibrations in the back pressure valve and increase the fluid volume flowing into the back pressure valve; so that the back pressure drops below the specified pressure, and therefore a correct orbital scroll pushup force cannot be achieved, causing problems such as drop in efficiency. In the method disclosed in patent literature 1, the orbital edge plate serves as an intermittent structure to block the back pressure valve inflow hole when the pressure on the orbital edge plate side surface is highest so that the pressure fluctuation width at the back pressure valve inflow hole dropped to a small level relative to the pressure fluctuation width at the orbital edge plate side surface. However, the back pressure valve inflow hole is fully open when the pressure on the orbital edge plate side surface is lowest, and the pressure on the orbital edge plate side surface acts directly on the back pressure valve plate causing the concern that problems from the above described drop in back pressure may occur under conditions where pressure fluctuations become large during high speed rotation.

In scroll compressors containing a back pressure control means that opens and closes by way of a pressure differential an object of the present invention is to provide a highly efficient and highly reliable compressor capable of maintaining the back pressure at a proper stable level even under operating conditions where pressure fluctuations of the orbital edge plate side surface become large.

Solution to Problem

In order to achieve the above described objects, the scroll compressor of the present invention includes a crankshaft to mutually engage a stationary scroll having a whirlpool shape on the base plate and an orbiting scroll, and drive the orbiting scroll; a suction chamber and a compression chamber formed between the orbiting scroll and stationary scroll by the orbital motion of the orbiting scroll accompanying the rotation of the crankshaft; a back pressure chamber included in the back surface of the orbital scroll to apply a pressing force on the stationary scroll to the orbiting scroll by a pressure that is higher than the pressure in the suction chamber; a communication path in the stationary scroll for connecting the suction chamber or the compression chamber and the back pressure chamber; and a back pressure control means for opening and closing the communication path by way of the pressure differential along the communication path; and in which an inlet communication path that extends from the back pressure control means of the communication path to the back pressure chamber includes at least two or more path cross-sectional areas, and the cross-sectional area of the inlet communication path on the back pressure chamber side is formed larger than the cross-sectional area of an inlet communication path located on the back pressure control means side, and configured so that the opening surface area of the back pressure chamber side of the inlet communication path on the back pressure chamber side is always equal to or smaller than the cross-sectional area of the inlet communication path on the back pressure control means side, by the base plate of the orbiting scroll always blocking part of the back pressure chamber side opening of the inlet communication path on the back pressure chamber side.

Even in cases where using a structure to intermittently connect to a communication path by opening and closing the back pressure chamber side opening of the communication path by way of the base plate of the orbiting scroll, a structure can be configured where the opening surface area of the back pressure chamber side of the communication path is equal to or smaller than a cross-sectional area of the communication path of the back pressure control means side, even during the maximum opening.

Moreover, a groove extending to the outer circumferential side may be formed in a section of the back pressure chamber side opening of the inlet communication path on the back pressure chamber side, in which the groove is blocked by the base plate of the orbiting scroll so that the edge of the groove is opened to the back pressure chamber side; and the opening surface area of the groove is always equal to or smaller than the cross-sectional area of the inlet communication path on the back pressure control means side.

A groove or a hole connecting the back pressure chamber side opening of the back pressure chamber side inlet communication path with the back pressure chamber can be formed over the base plate of the orbiting scroll, so that the opening surface area of the groove or hole is equal to or smaller than the cross-sectional area of the inlet communication path on the back pressure control means side.

Advantageous Effects of Invention

The scroll compressor of the present invention including a back pressure control means that opens and closes by differential pressure, is configured so that cross-sectional area of the communication path on the back pressure chamber side of the communication path connecting the suction chamber or the compression chamber and the back pressure chamber is larger than the cross-sectional area of the communication path of the back pressure control means, and also the opening surface area on the back pressure chamber side is always equal to or smaller than the cross-sectional area of the communication path on the back pressure control means side so that a pressure fluctuation transmittance suppression effect is obtained according to the enlargement or shrinkage of the path. Pressure fluctuations acting on the back pressure control means can therefore be suppressed even under operating conditions where pressure fluctuations on the orbital edge plate side surface have become large, and abnormal vibrations in the back pressure control means can be prevented so that the back pressure can be maintained at an appropriately stable level and a highly efficient and highly reliable scroll compressor can be achieved.

DESCRIPTION OF EMBODIMENTS

Figure 1:
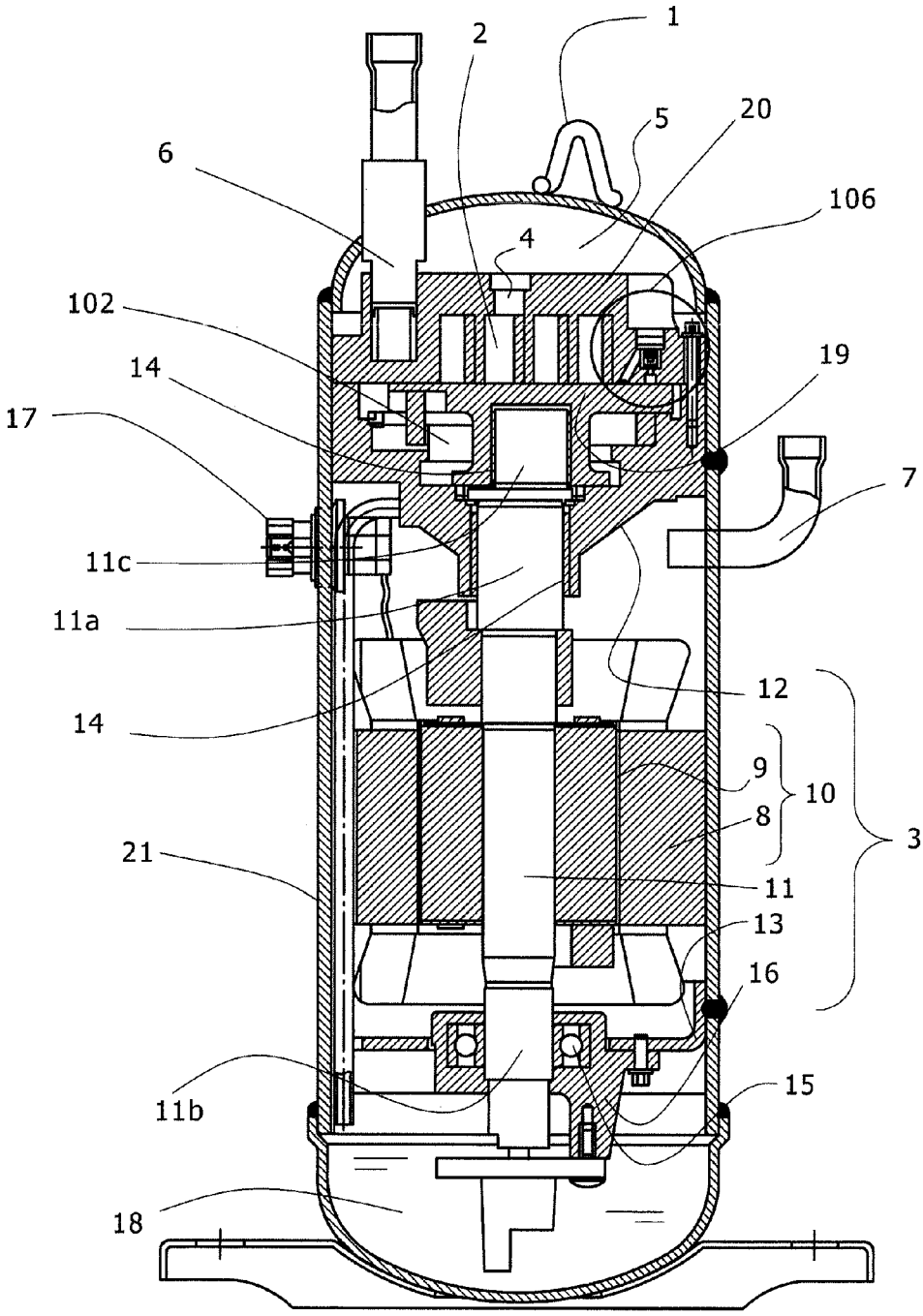
FIG. 1 is a vertical cross-sectional view showing the scroll compressor of the first embodiment of the present invention.

The embodiments of the present invention are described next in detail while referring to the accompanying drawings. Sections in the drawings having identical reference numeral indicate identical or equivalent sections.

First Embodiment

The scroll compressor of the first embodiment is shown in FIG. 1. The overall structure of the scroll compressor is first of all described. A scroll compressor 1 includes a drive section 3 and a compressor containing a stationary scroll 20 orbiting scroll 19 within a sealed container 21. The drive section 3 is comprised of an electric motor 10 containing a stator 8 and a rotor 9, a crankshaft 11, a frame 12, an auxiliary frame 13, and an auxiliary shaft bearing housing 16 as basic structural elements. Here, the electric motor 10 is driven by electrical input from an inverter (not shown in the drawing) byway of the electrical terminal 17 to apply a rotating effect to the crankshaft 11. The crankshaft 11 includes a main shaft 11*a* and an auxiliary shaft 11*b* and an eccentric pin 11*c*. The shaft bearing 14 mounted in the frame 12, and the shaft bearing 15 mounted in the auxiliary shaft bearing housing 16 form shaft bearings supporting the main shaft 11*a* and auxiliary shaft 11*b* of the crankshaft 11 for free rotation. The fluid 18 for lubricating the shaft bearings 14, 15 is accumulated within the sealed container 21. The frame 12 and the auxiliary frame 13 joined to the auxiliary shaft housing 16 are clamped to the sealed container 21. The rotational effect of the crankshaft 11 exerts a compressive action that reduces the volume of the compression chamber 2 mechanically formed by the mutual engagement of the stationary scroll 20 and orbiting scroll 19. The operating fluid is suctioned from the suction pipe 6 into the compression chamber 2 is dispensed by way of the compression stroke from the dispensing port 4 to the dispensing space 5 within the sealed container 21, and is further dispensed from the dispensing pipe 7 to outside the sealed container 21.

In order to maintain the sealing of the compression chamber 2, the intermediate pressure (hereafter called back pressure) between the dispensing pressure and suction pressure acts on the back space (hereafter called back pressure chamber 102) of the orbiting scroll 19 to press the orbiting scroll 19 against the stationary scroll 20. By utilizing the back pressure control means 106 installed in the stationary scroll 20 to generate and maintain a correct back pressure, energy loss caused by coolant leakage during compression operation can be reduced and satisfactory reliability for the push-sliding action of the orbiting scroll 19 can be ensured.

Figure 2:
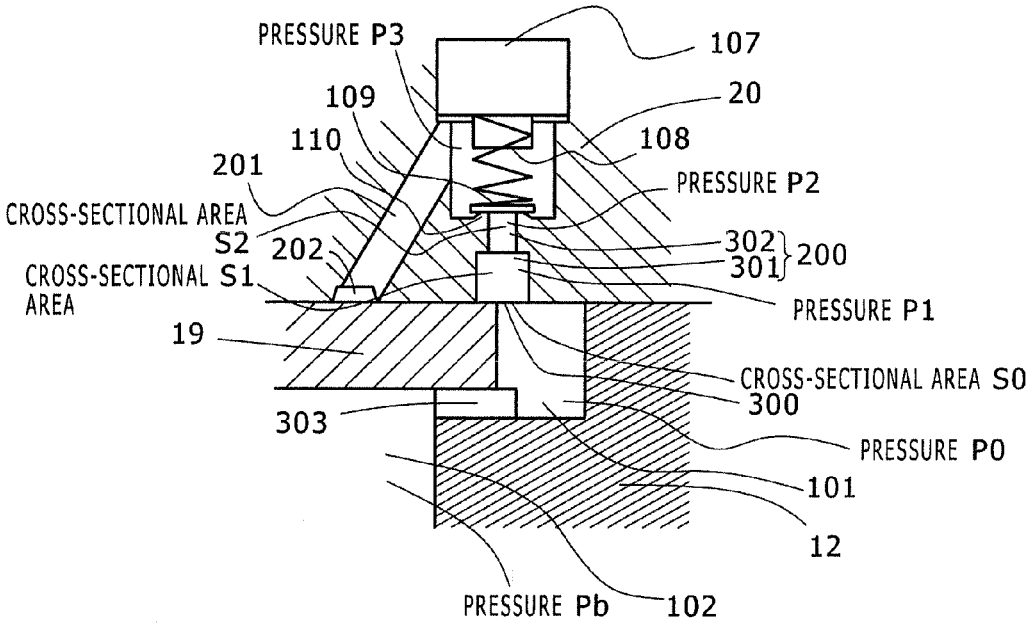
FIG. 2 is an enlarged view of essential sections in the vicinity of the back pressure control means shown in FIG. 1.
Figure 3:
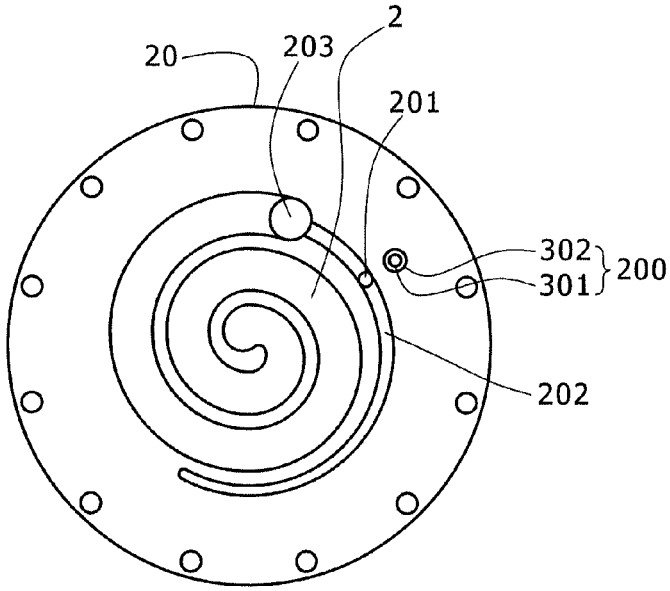
FIG. 3 is a bottom view of the stationary scroll shown in FIG. 1.
Figure 4:
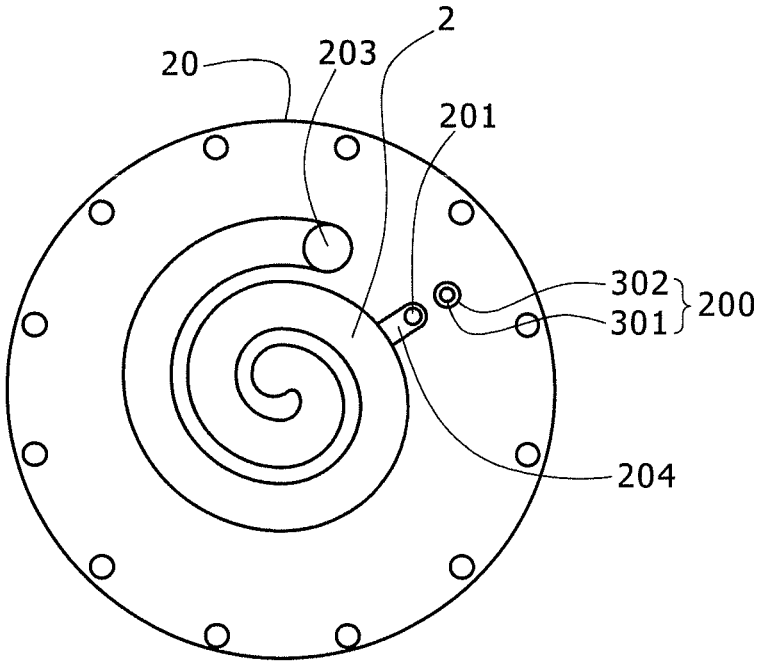
FIG. 4 is a bottom view showing another example of the stationary scroll shown in FIG. 1.

The structure of the back pressure control means 106 is described while referring to FIG. 2 through FIG. 4. FIG. 2 is a drawing showing in detail the back pressure control means 106 shown in FIG. 1. The back pressure control means 106 is comprised of a seal member 107, a spring 108, a valve body 109, and a sheet 110, and is mounted between an inlet communication path 200 and an outlet communication path 201. The inlet side of the inlet communication path 200 is an opening to the sliding surface with a base plate 100 of the orbiting scroll of the stationary scroll 20, and fulfills the task of connecting the back pressure chamber 102 to the back pressure control means 106. The inlet communication path 200 is configured from an inlet communication path 301 on the back pressure chamber 102 side, and an inlet communication path 302 on the back pressure control means 106 side; and the cross-sectional area S1 of the path 301 is formed larger than the cross-sectional area S2 of the path 302.

The outlet side of the outlet communication path 201 is an opening to a suction groove 202 of the stationary scroll, and fulfills the task of connecting the back pressure control means 106 with the suction groove 202.

FIG. 3 is a bottom view of the stationary scroll 20 shown in FIG. 1 and FIG. 2. The suction groove 202 is connected to a suction space 203 as shown in FIG. 3. The outlet communication path 201 may be formed as an opening to an intermediate pressure groove 204 connecting to the compression chamber 2 as shown in FIG. 4. In the following description, a structure opening to the suction groove 202 (FIG. 3) is utilized as an example.

In the state shown in FIG. 2 with the compressor stopped, the valve body 109 is pressed against the sheet 110 by the spring weight of the spring 108. In a state where the compressor is operating, the pressure in the suction groove 202 connecting to the suction space 203 drops, and by way of the outlet communication path 201 the upper section pressure P3 of the valve body 109 drops to a pressure lower than the pressure P2 inside the path 302 which is the bottom section of the valve body 109. When the weight acting on the valve body 109 becomes larger than the spring weight of the spring 108 due to the pressure differential between the pressure P2 and pressure P3, the valve body 109 opens, to allow gas and oil to flow from the back pressure chamber 102 into the suction groove 202, exerting back pressure control to maintain the pressure Pb inside the back pressure chamber 102 at a specified pressure.

Figure 5:
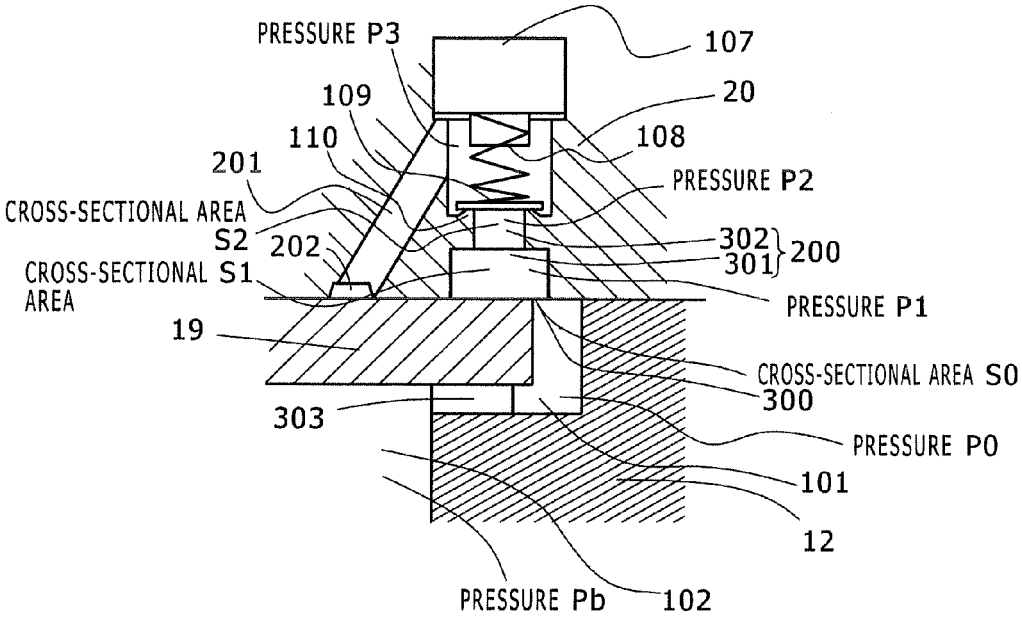
FIG. 5 is an enlarged view of essential sections in the vicinity of the back pressure control means shown in FIG. 1: (a) is a drawing showing the state when the base plate of orbiting scroll is closest to the outer circumference; and (b) is a drawing showing the state when the base plate of orbiting scroll is farthest from the outer circumference.
Figure 5:
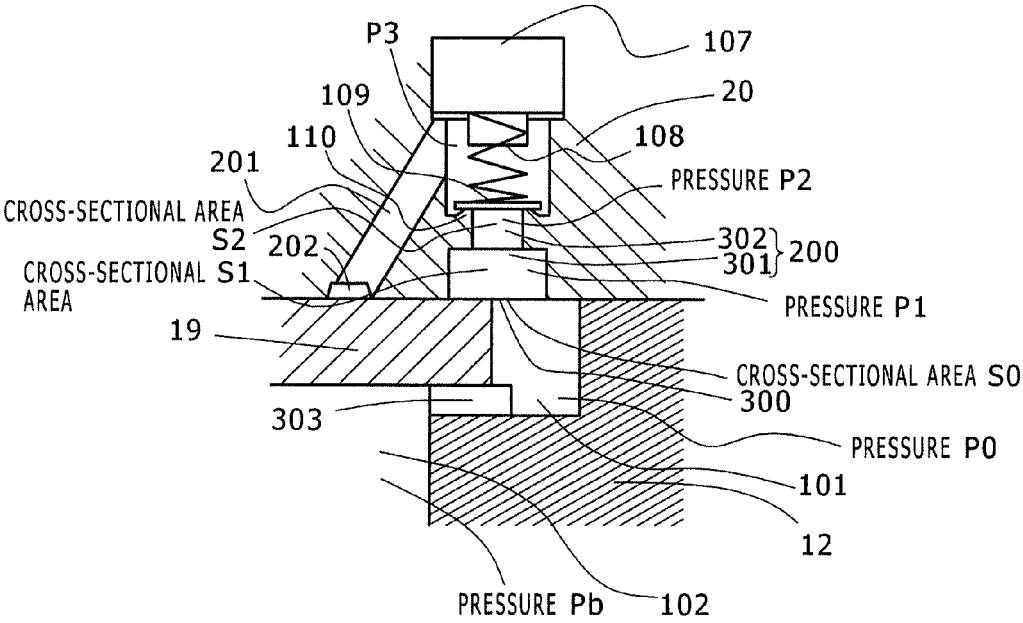

FIG. 5 is a drawing showing the positional relationship between the inlet communication path 200 and the base plate 100 of the orbiting scroll of the first embodiment. A base plate 100 of the orbiting scroll has an orbital motion so the outer circumferential end of the base plate moves below the inlet communication path 200. An opening 300 is formed in a state where the base plate 100 of the orbiting scroll blocks a section of the inlet of the inlet communication path 301 on the back pressure chamber side. The surface area S0 of the opening 300 is configured to always be an identical to or smaller than the cross-sectional area S2 of the inlet communication path 302 on the back pressure control means 106 side and always connects the path 301 with outer circumferential space 101.

The outer circumferential space 101 of the base plate of the orbiting scroll is connected to the back pressure chamber 102 of the base plate 100 of the orbiting scroll by way of the path 303. However fluctuations in the pressure differential applied by the gas compression effect that accompanies movement of the base plate 100 of the orbiting scroll relative to the back pressure Pb occur in the outer circumferential pressure P0. The pressure as shown in (a) in the figure reaches a maximum at the position where the base plate 100 of the orbiting scroll is closest to the outer circumference; and the pressure as shown in (b) in the figure reaches a minimum at the position where the base plate 100 of the orbiting scroll approaches the inner side (position farthest from outer circumference). When the fluctuation in outer circumferential pressure P0 is directly conveyed to the path 302 which is the bottom section of the valve body 109, the valve body 109 causes an abnormal vibration due to effects from the pressure fluctuation, so that the flow rate of gas and oil passing through the back pressure control means 106 increases, leading to a drop in the back pressure Pb. In the present embodiment, the path 301 forms an enlarged space between the constricted opening 300 and the constricted path 302 as described above, so that transmitta0 is suppressed, providing the effect of minimizing fluctuations in the pressure P2, and preventing problems from a drop in the back pressure Pb.

The pressing force from the orbiting scroll 19 on the stationary scroll 20 can in this way be correctly maintained and the supply of oil to the compression chamber can also be maintained at a correct level, so that coolant leakage losses during the compression operation can be prevented and the energy efficiency improved. Providing a correct back pressure also improves the reliability of the sliding action of the orbiting scroll 19. A scroll compressor capable of high energy efficiency and high reliability can therefore be provided.

Second Embodiment

Figure 6:
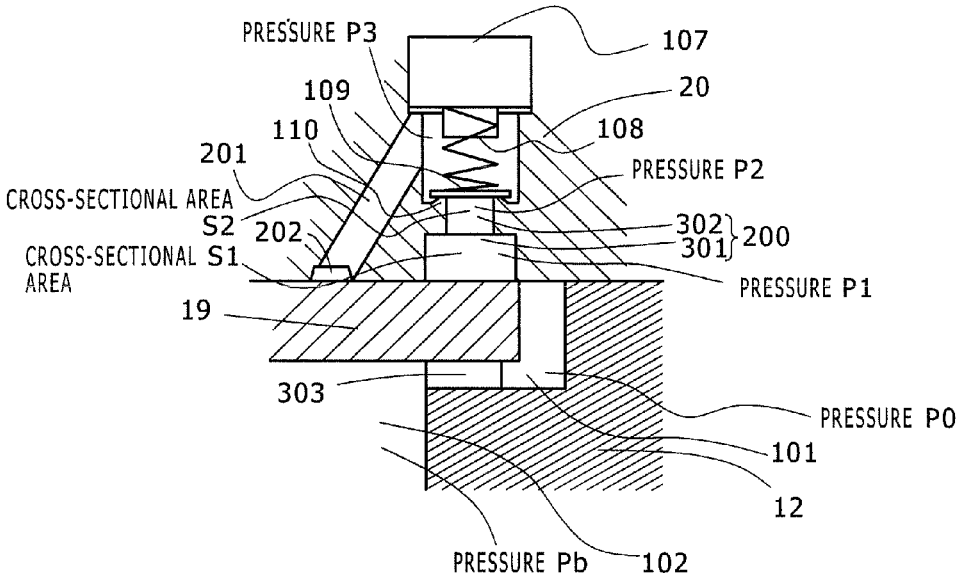
FIG. 6 is a drawing equivalent to FIG. 5, as an enlarged view of essential sections showing the scroll compressor of the second embodiment of the present invention.
Figure 6:
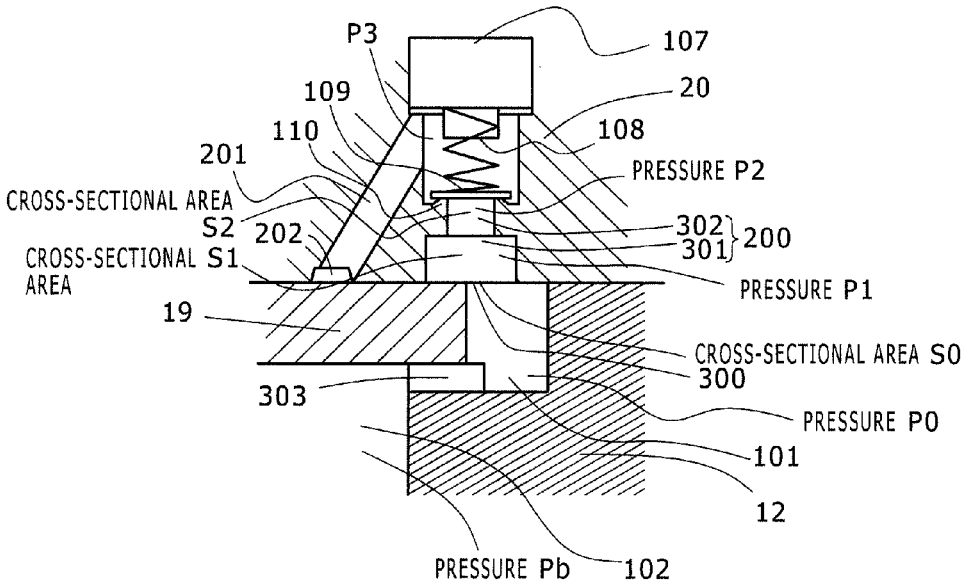

The second embodiment of the scroll compressor of the present invention is described while referring to FIG. 6. FIG. 6 is a drawing equivalent to FIG. 5.

This embodiment is configured so that the surface area S0 of the opening 300 is equivalent or smaller than the cross-sectional area S2 of the inlet communication path 302 on the back pressure control means side, the same as in the first embodiment. The second embodiment differs from the first embodiment in the point that there is a time in which the inlet communication path 301 on the back pressure chamber side is temporarily fully closed by the base plate 100 of the orbiting scroll; and in the point that the path 301 intermittently connects to the outer circumferential space 101. By configuring the present embodiment so that the path 301 does not connect to the outer circumferential space 101 when the outer circumferential pressure P0 is high, a pressure P2 can be maintained with greater stability within the path 302 and problems from a drop in the back pressure Pb can be prevented.

Third Embodiment

Figure 7:
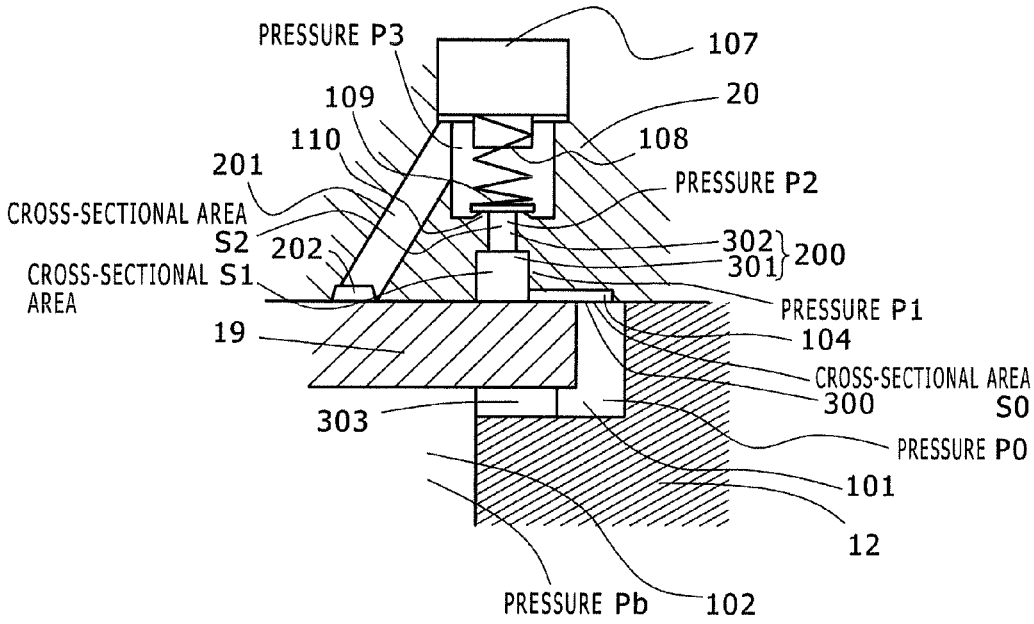
FIG. 7 is a drawing equivalent to FIG. 5, showing an enlarged view of essential sections of the scroll compressor of the third embodiment of the present invention.
Figure 7:
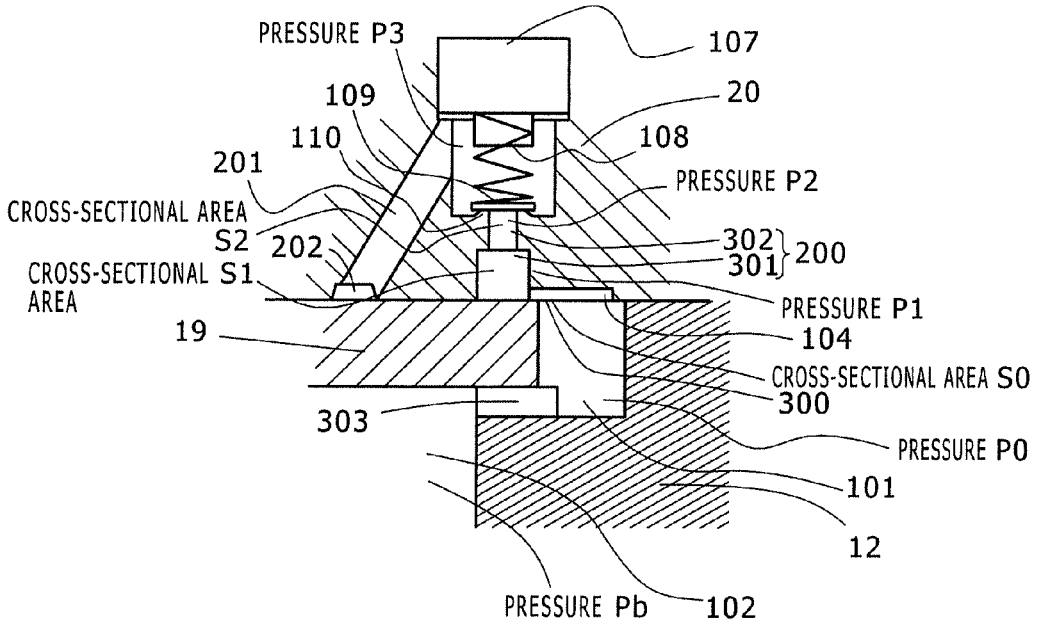
Figure 8:
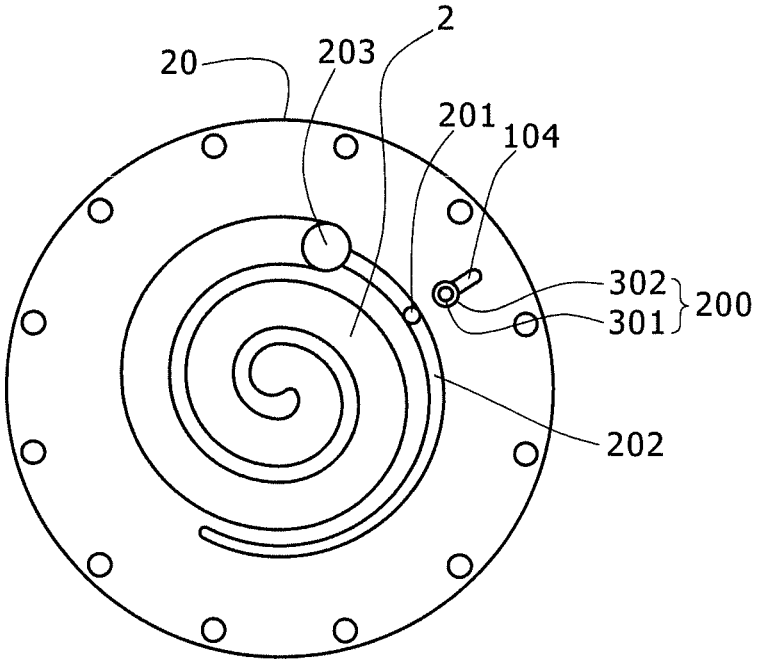
FIG. 8 is a bottom view of the stationary scroll in the third embodiment shown in FIG. 7.

The third embodiment of the scroll compressor of the present invention is described while referring to FIG. 7 and FIG. 8. FIG. 7 is a drawing equivalent to FIG. 5. FIG. 8 is a bottom view of the stationary scroll of the third embodiment and is a drawing for describing the shape of the groove 104 formed in the stationary scroll.

In the present embodiment, a groove 104 extending from the inlet communication path 301 on the back pressure chamber side towards the outer circumference is formed over the base plate surface of the stationary scroll. A base plate 100 of the stationary scroll is positioned below this groove 104, and the outer circumferential edge of the groove 104 is configured to be on the outer side from the outer circumferential edge of the base plate 100 of the orbiting scroll. A structure was in this way configured that always connects the inlet communication path 301 on the back pressure chamber side with the outer circumferential space 101. The cross-sectional area S0 of the groove 104 is made identical to or smaller than the cross-sectional area S2 of the inlet communication path 302 on the back pressure control means side. The path 301 forms an enlarged space between the constricted groove 104 and the constricted path 302 so that the transmittance of fluctuations in the outer circumferential pressure P0 within the path 302 is suppressed, and an effect that reduces fluctuations in pressure P2 is obtained, and the problem of a drop in back pressure Pb is prevented.

Configuring a structure for the present invention according to the indicated dimensions is difficult in the above described first or second embodiments due to the size of the orbital radius. The third embodiment however can be easily configured by adjusting the length of the groove 104 and is not susceptible to effects from the orbital radius.

Fourth Embodiment

Figure 9:
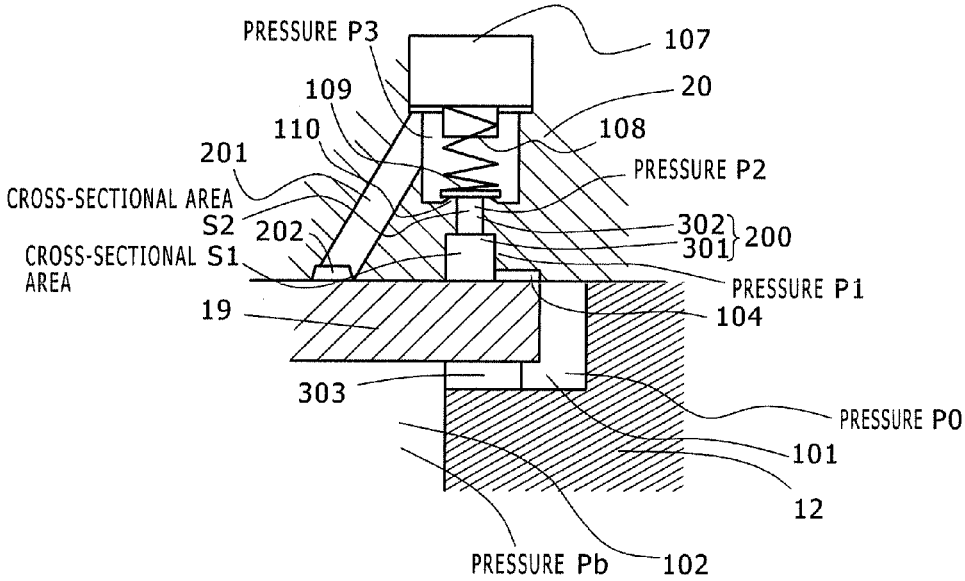
FIG. 9 is a drawing equivalent to FIG. 5, showing an enlarged view of essential sections of the scroll compressor of the fourth embodiment of the present invention.
Figure 9:
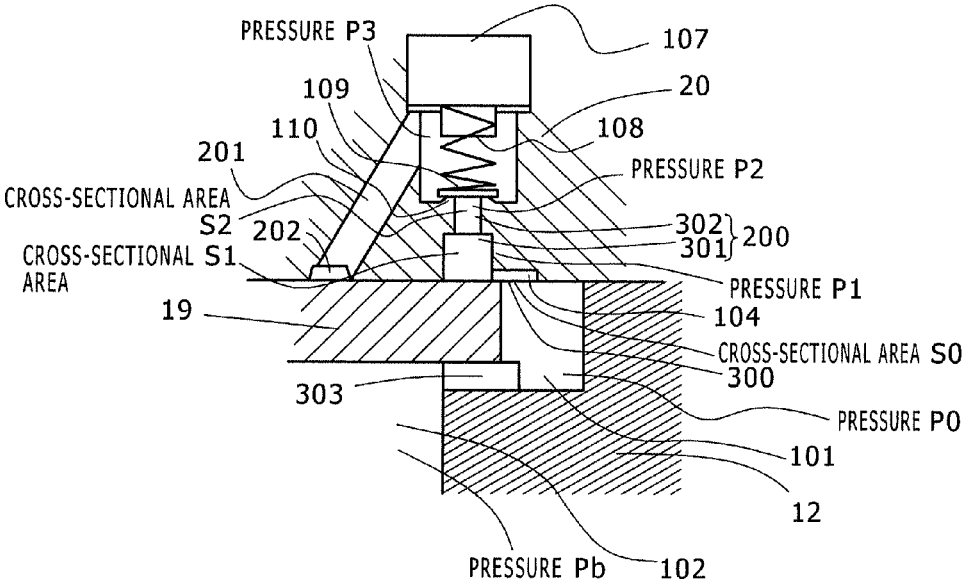

The fourth embodiment of the scroll compressor of the present invention is described while referring to FIG. 9. FIG. 9 is a drawing equivalent to FIG. 5.

The point where the fourth embodiment differs from the third embodiment is that the outer circumferential edge of the groove 104 is configured to temporarily function as the inner side from the outer circumferential edge of the base plate 100 of the orbiting scroll. Utilizing this type of configuration allows a structure that is capable of intermittently connecting the inlet communication path 301 on the back pressure chamber side and the outer circumferential space 101. Utilizing this embodiment, allows configuring a structure where the path 301 and outer circumferential space 101 are not connected when the outer circumferential pressure P0 is high, and maintains the pressure P2 with greater stability within the inlet communication path 302 on the back pressure control means side.

Configuring a structure for the present invention according to the indicated dimensions is difficult in the above described first or second embodiments due to the size of the orbital radius. The fourth embodiment however can be easily configured by adjusting the length of the groove 104 and is not susceptible to effects from the orbital radius.

Fifth Embodiment

Figure 10:
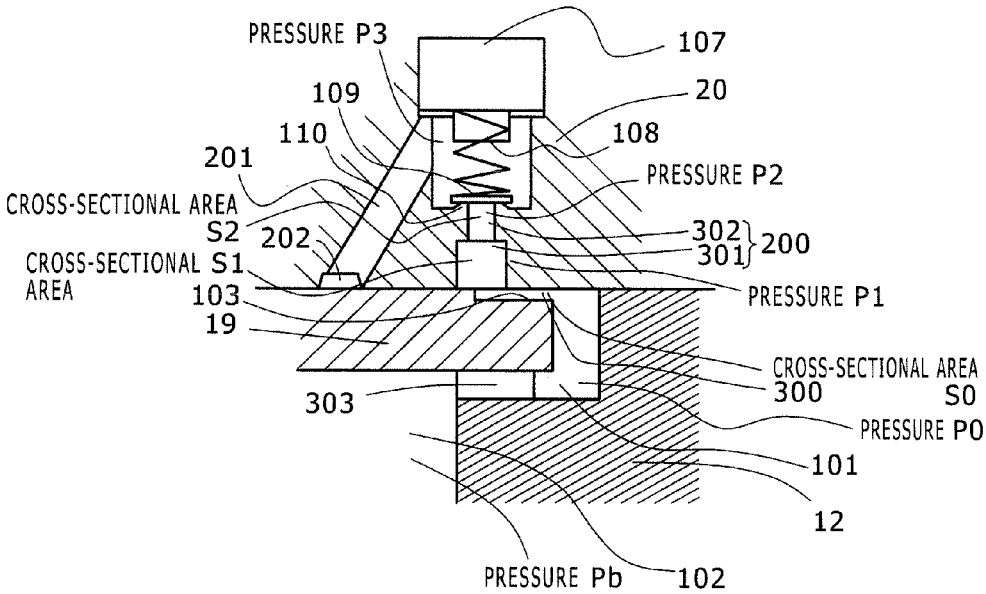
FIG. 10 is a drawing equivalent to FIG. 5, showing an enlarged view of essential sections of the scroll compressor of the fifth embodiment of the present invention.
Figure 10:
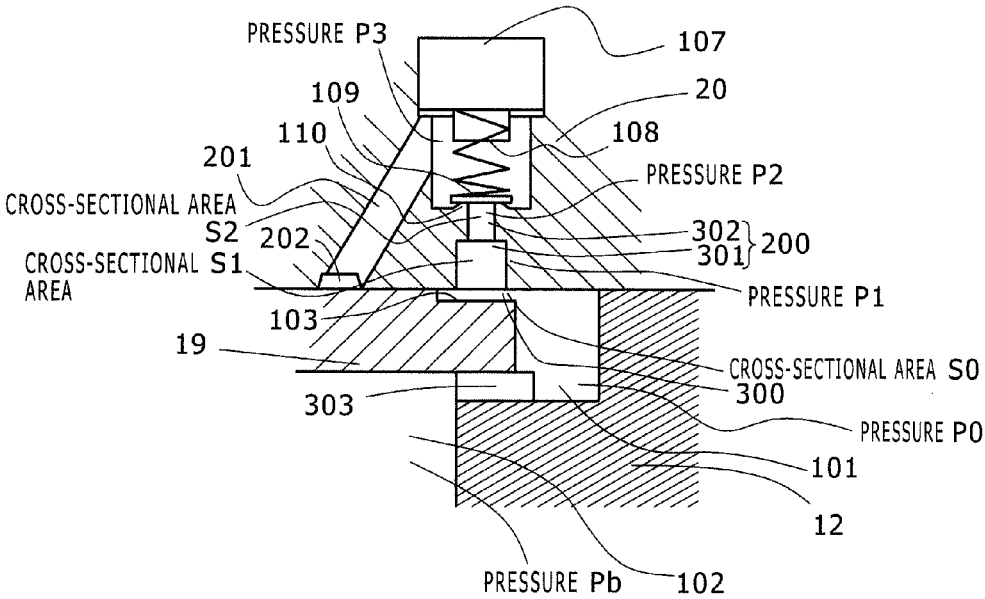
Figure 11:
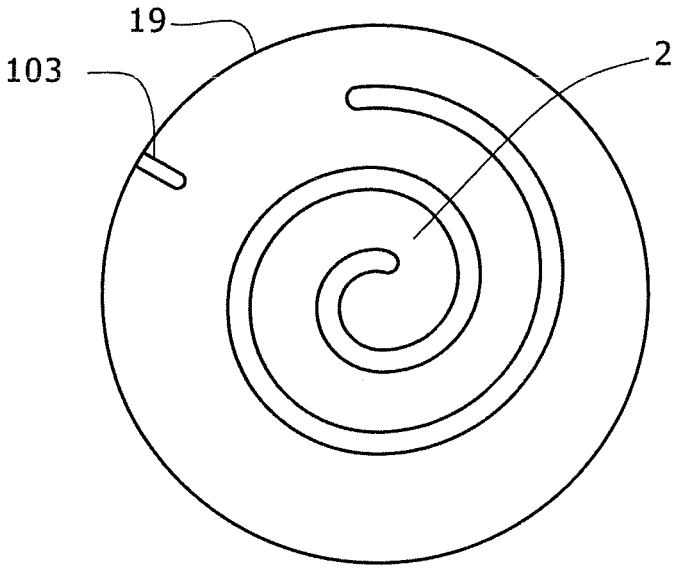
FIG. 11 is a flat view of the orbiting scroll of the fifth embodiment shown in FIG. 10.

The fifth embodiment of the scroll compressor of the present invention is described while referring to FIG. 10 and FIG. 11. FIG. 10 is a drawing equivalent to FIG. 5. FIG. 11 is a flat view of the orbiting scroll of the fifth embodiment and is a drawing for describing the shape of the groove 103 formed in the orbiting scroll.

In the present embodiment, a groove 103 extending to the outer circumferential edge is formed over the base plate surface of the orbiting scroll, and configured so that an inlet communication path 301 on the back pressure chamber side of the stationary scroll is positioned permanently on that applicable groove 103, and so that the path 301 and outer circumferential space 101 are constantly connected to each other. The cross-sectional area S0 of the groove 103 is configured to be identical to or smaller than the cross-sectional area S2 of the inlet communication path 302 on the back pressure control means side. The path 301 forms an enlarged space between the constricted groove 103 and the constricted path 302 so that the transmittance of fluctuations in the outer circumferential pressure P0 within the path 302 is suppressed, and an effect that reduces fluctuations in pressure P2 is obtained, and the problem of a drop in back pressure Pb is prevented.

Configuring a structure for the present invention according to the indicated dimensions is difficult in the above described first or second embodiments due to the size of the orbital radius. The fifth embodiment however can be easily configured by adjusting the length of the groove 103 and is not susceptible to effects from the orbital radius.

Sixth Embodiment

Figure 12:
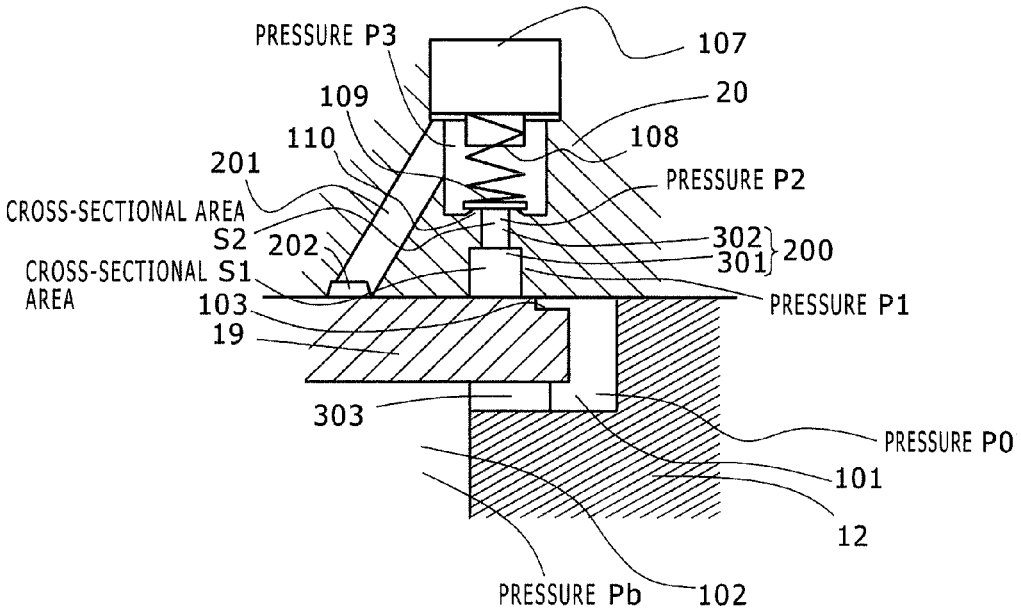
FIG. 12 is a drawing equivalent to FIG. 5, showing an enlarged view of essential sections of the scroll compressor of the sixth embodiment of the present invention.
Figure 12:
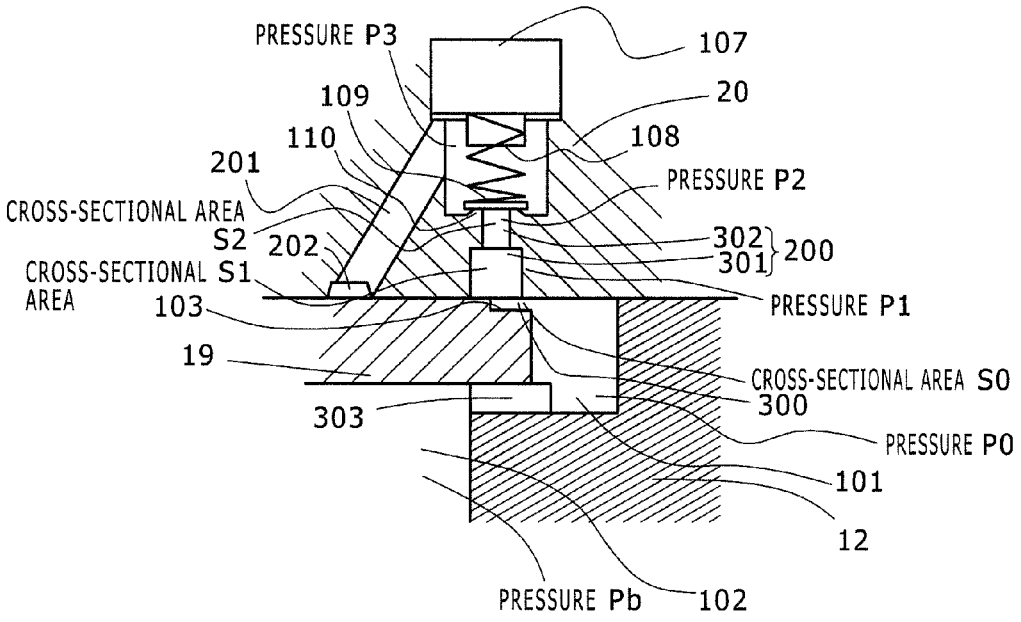

The sixth embodiment of the scroll compressor of the present invention is described referring to FIG. 12. FIG. 12 is a drawing equivalent to FIG. 5.

The point where the sixth embodiment differs from the above described fifth embodiment is that an inlet communication path 301 on the back pressure chamber side of the stationary scroll is temporarily positioned on the groove 103, in a structure where the path 301 and the outer circumferential space 101 are intermittently connected. Utilizing this embodiment, allows configuring a structure where the path 301 and outer circumferential space 101 are not connected when the outer circumferential pressure P0 is high, and maintains the pressure P2 with greater stability within the inlet communication path 302 on the back pressure control means side.

Configuring a structure for the present invention according to the indicated dimensions is difficult in the above described first or second embodiment due to the size of the orbital radius. The sixth embodiment however can be easily configured by adjusting the length of the groove 103 and is not susceptible to effects from the orbital radius.

Seventh Embodiment

Figure 13:
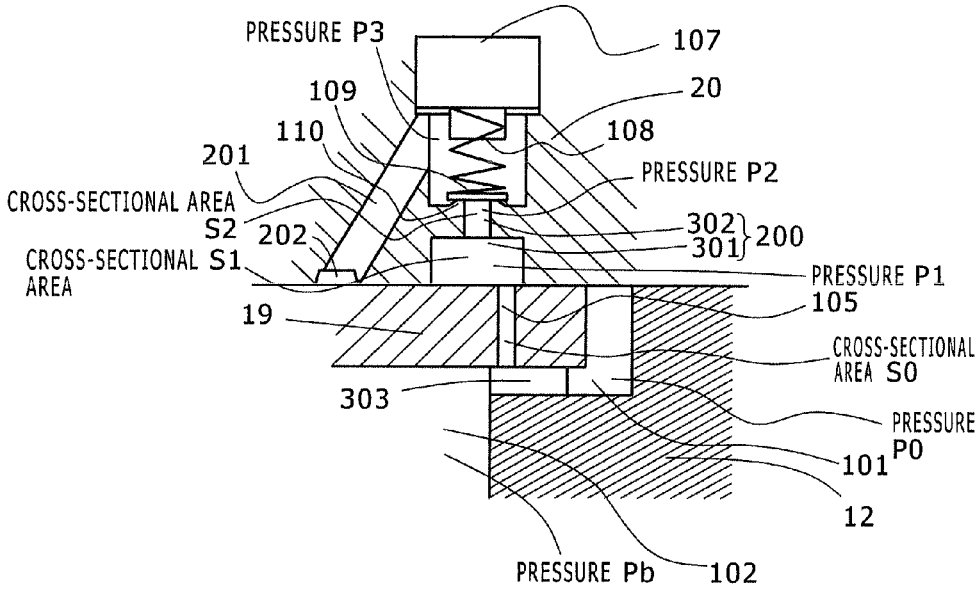
FIG. 13 is a drawing equivalent to FIG. 5, showing an enlarged view of essential sections of the scroll compressor of the seventh embodiment of the present invention.
Figure 13:
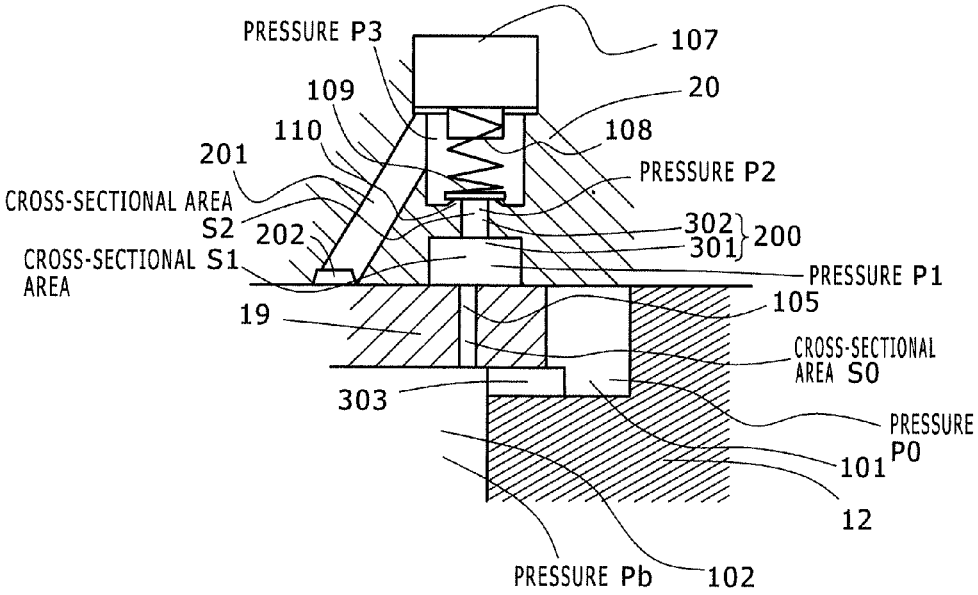
Figure 14:
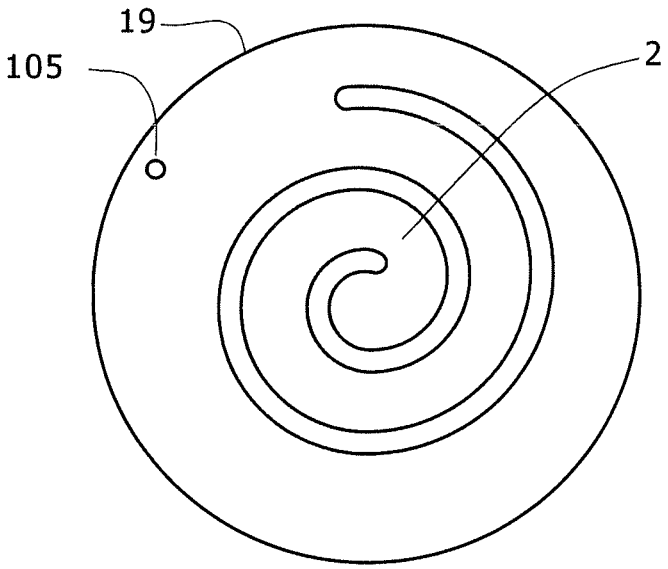
FIG. 14 is a flat view of the orbiting scroll of the seventh embodiment shown in FIG. 13.

The seventh embodiment of the scroll compressor of the present invention is described next while referring to FIG. 13 and FIG. 14. FIG. 13 is a drawing equivalent to FIG. 5. FIG. 14 is a flat view of the orbiting scroll of the seventh embodiment, and is a drawing for describing the hole 105 formed in the orbiting scroll.

In the present embodiment, a hole 105 is formed in the base plate surface of the orbiting scroll; and configured so that an inlet communication path 301 on the back pressure chamber side of the stationary scroll is positioned permanently on the hole 105, and so that the path 301 and outer circumferential space 101 are constantly connected to each other. The cross-sectional area S0 of the hole 105 is configured to be identical to or smaller than the cross-sectional area S2 of the inlet communication path 302 on the back pressure control means side. The path 301 forms an enlarged space between the constricted hole 105 and the constricted path 302 so that the transmittance of fluctuations in the outer circumferential pressure P0 within the path 302 is suppressed, and an effect that reduces fluctuations in pressure P2 is obtained, and the problem of a drop in back pressure Pb is prevented.

Eighth Embodiment

Figure 15:
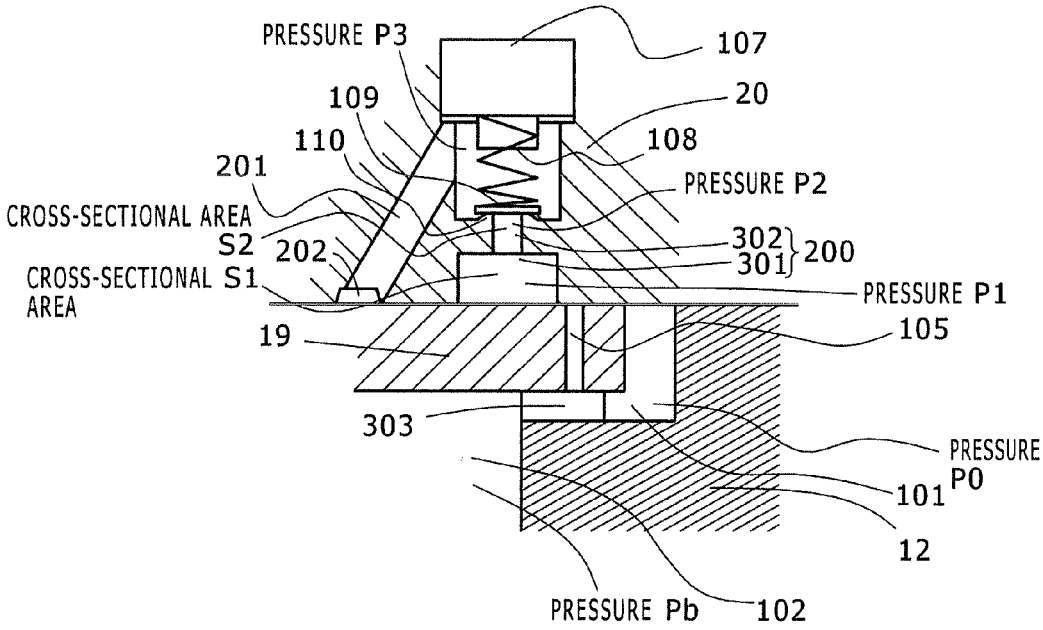
FIG. 15 is a drawing equivalent to FIG. 5, showing an enlarged view of essential sections of the scroll compressor of the eight embodiment of the present invention.
Figure 15:
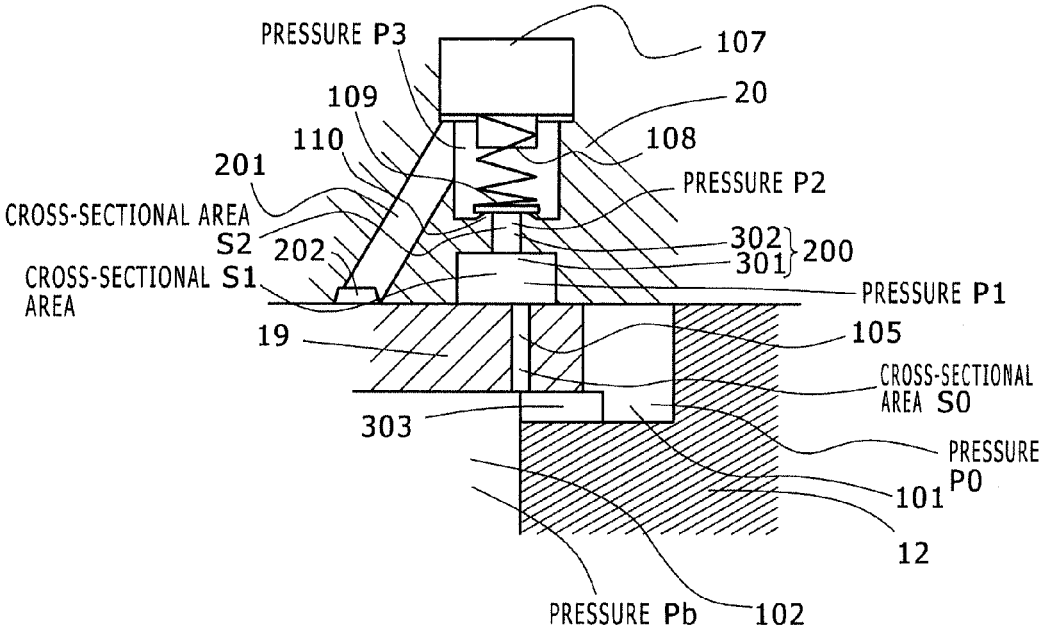

The eighth embodiment of the scroll compressor of the present invention is described next while referring to FIG. 15. FIG. 15 is a drawing equivalent to FIG. 5.

The point where the present embodiment differs from the above seventh embodiment is that an inlet communication path 301 on the back pressure chamber side of the stationary scroll is positioned temporarily on the hole 105, and so that the path 301 and outer circumferential space 101 are intermittently connected to each other. By utilizing a structure where the path 301 and outer circumferential space 101 are not connected when the outer circumferential pressure P0 is high, the pressure P2 within the inlet communication path 302 on the back pressure control means side can be maintained with greater stability.

LIST OF REFERENCE SIGNS

1: scroll compressor, 2: compression chamber, 3: drive section, 4: dispensing port, 5: dispensing space,
6: suction pipe, 7: dispensing pipe, 8: stator, 9: rotor, 10: electric motor,
11: crankshaft, 12: frame, 13: auxiliary frame,
14, 15: shaft bearing, 16: auxiliary shaft bearing housing,
17: electrical terminal, 18: fluid, 19: orbiting scroll, 20: stationary scroll,
21: sealed container,
100: base plate of the orbiting scroll, 101: outer circumferential space of the base plate of the orbiting scroll,
102: back pressure chamber,
103, 104: groove, 105: hole, 106: back pressure control means
107: seal member, 108: spring, 109: valve body, 110: sheet
200: inlet communication path, 201: outlet communication path,
202: suction groove, 203: suction space, 204: intermediate pressure groove,
300: opening,
301: inlet communication path on the back pressure chamber side, 302: inlet communication path on the back pressure control means side,
303: communication path between the back pressure chamber and the outer circumferential space of base plate of orbiting scroll,
S0: cross-sectional area of opening, S1: cross-sectional area of the inlet communication path on the back pressure chamber side
S2: cross-sectional area of the inlet communication path on the back pressure control means side,
P0: pressure in the cross-sectional area of the opening, P1: pressure in the inlet communication path on the back pressure chamber side,
P2: pressure in the inlet communication path on the back pressure control means side,
P3: pressure in the outlet communication path, Pb: pressure inside the back pressure chamber

The invention claimed is:

1. A scroll compressor comprising:
a crankshaft to mutually engage a stationary scroll having a whirlpool shape and an orbiting scroll, the crankshaft driving the orbiting scroll;
a suction chamber and a compression chamber formed between the orbiting scroll and the stationary scroll by orbital motion of the orbiting scroll accompanying a rotation of the crankshaft;
a back pressure chamber included on a back surface of the orbiting scroll to apply a pressing force that presses the stationary scroll against the orbiting scroll by a pressure that is higher than a suction chamber pressure;
a communication path formed in the stationary scroll that connects the suction chamber or the compression chamber and the back pressure chamber; and
a back pressure control means for opening and closing the communication path by way of a pressure differential along the communication path, wherein
an inlet communication path extending from the back pressure control means to the back pressure chamber includes at least two or more path cross-sectional areas,
a cross-sectional area of the inlet communication path on a back pressure chamber side on the inlet communication path is larger than a cross-sectional area of an inlet communication path on a back pressure control means side,
the scroll compressor is configured so that an opening surface area of the back pressure chamber side of the inlet communication path on the back pressure chamber side is always equal to or smaller than the cross-sectional area of the inlet communication path on the back pressure control means side, and
a base plate of the orbiting scroll always blocks part of a back pressure chamber side opening of the inlet communication path on the back pressure chamber side.

2. The scroll compressor according to claim 1, wherein
a groove extending to an outer circumferential side is formed in part of the back pressure chamber side opening of the inlet communication path on the back pressure chamber side, with the groove blocked by the base plate of the orbiting scroll so that an edge of the groove is open to the back pressure chamber side; and
an opening surface area of the groove is always equal to or smaller than the cross-sectional area of the inlet communication path on the back pressure control means side.

3. The scroll compressor according to claim 1, wherein a groove connecting the back pressure chamber side opening of the inlet communication path on the back pressure chamber side with the back pressure chamber is formed on the base plate of the orbiting scroll, so that an opening surface area of the groove is equal to or smaller than the cross-sectional area of the inlet communication path on the back pressure control means side.

4. The scroll compressor according to claim 1, wherein a hole connecting the back pressure chamber side opening of the inlet communication path on the back pressure side with the back pressure chamber is formed on the base plate of the orbiting scroll, so that a surface area of the hole is equal to or smaller than the cross-sectional area of the inlet communication path on the back pressure control means side.

5. A scroll compressor comprising:
a crankshaft to mutually engage a stationary scroll having a whirlpool shape and an orbiting scroll, the crankshaft driving the orbiting scroll;
a suction chamber and a compression chamber formed between the orbiting scroll and stationary scroll by orbital motion of the orbiting scroll accompanying a rotation of the crankshaft;
a back pressure chamber on a back surface of the orbiting scroll to apply a pressing force that presses the stationary scroll against the orbiting scroll by a pressure that is higher than a suction chamber pressure;
a communication path formed in the stationary scroll that connects the suction chamber or the compression chamber and the back pressure chamber;
a back pressure control means for opening and closing the communication path by way of a pressure differential along the communication path,
a base plate of the orbiting scroll that intermittently connects the communication path by opening and closing an opening on a back pressure chamber side of the communication path, wherein
an inlet communication path extending from the back pressure control means to the back pressure chamber includes at least two or more path cross-sectional areas,
a cross-sectional area of the inlet communication path on a back pressure chamber side on the inlet communication path is larger than a cross-sectional area of an inlet communication path on a back pressure control means side, and along with the base plate of the orbiting scroll blocking part of the opening, even when a back pressure chamber side opening of the inlet communication path on a back pressure side is in a maximum opened state, a surface area of an opening on the back pressure chamber side of the communication path on the back pressure chamber side is configured so as to be equal to or smaller than the cross-sectional area of the inlet communication path on the back pressure control means side.

* * * * *